United States Patent [19]

Follette

[11] 3,951,625

[45] Apr. 20, 1976

[54] AIR CONDITIONING APPARATUS

[76] Inventor: Donald T. Follette, 98 Sleight Plass Road, Poughkeepsie, N.Y. 12603

[22] Filed: Feb. 27, 1975

[21] Appl. No.: 553,500

Related U.S. Application Data

[63] Continuation-in-part of Ser. No. 284,909, Aug. 30, 1972, Pat. No. 3,869,529.

[52] U.S. Cl. ..... 55/232; 55/481; 261/130; 261/142; 261/80; 261/19; 261/DIG. 34; 261/64 R; 261/43; 236/44 C; 236/78 R

[51] Int. Cl.[2] ..... B01F 3/04

[58] Field of Search ..... 261/64 R, 43, DIG. 34, 261/142, 130, 80, 19; 236/44 A, 78, 78 D, 44 C; 55/232, 481

[56] References Cited

UNITED STATES PATENTS

| | | | |
|---|---|---|---|
| 691,312 | 1/1902 | Hart | 261/80 |
| 1,100,677 | 6/1914 | Leach | 261/80 |
| 1,817,442 | 8/1931 | Martin, Jr. | 261/80 |
| 1,970,301 | 8/1934 | Frankel | 261/80 |
| 1,976,401 | 10/1934 | Ilg | 261/80 |
| 2,035,653 | 3/1936 | Haskell | 261/142 |
| 2,062,042 | 11/1936 | Sargent | 261/142 |
| 2,074,265 | 3/1937 | Kirby | 261/DIG. 4 |
| 2,090,624 | 8/1937 | Drake | 261/DIG. 34 |
| 2,093,936 | 9/1937 | Spielmann | 261/DIG. 34 |
| 2,236,480 | 3/1941 | Loepsinger | 261/DIG. 34 |
| 3,339,902 | 9/1967 | Martin | 261/80 |
| 3,352,353 | 11/1967 | Stevens et al. | 261/DIG. 4 |
| 3,476,365 | 11/1969 | Agerley | 261/80 |
| 3,512,077 | 5/1970 | Evalds | 236/78 D |
| 3,563,458 | 2/1971 | Martin | 236/44 A |
| 3,684,171 | 8/1972 | Evalds | 236/78 |
| 3,684,172 | 8/1972 | Evalds | 236/78 |

*Primary Examiner*—Tim R. Miles
*Attorney, Agent, or Firm*—Bernard Malina

[57] ABSTRACT

Air conditioning apparatus ventilates room air with environmental air after the environmental air has been filtered, heated and humidified to appropriate levels. Environmental air is drawn into an intake duct, is passed successively through an air filter, an electric filament heater and is humidified by directing the air stream through a moving evaporator belt which is saturated with water from a water tank which is automatically controlled by a humidistat. The humidity level and temperature are automatically maintained by means of the humidistat and air temperature sensor.

7 Claims, 12 Drawing Figures

BLOWER WINDINGS

2–3 LOW BLOWER AIR FLOW
1–3 HIGH BLOWER AIR FLOW

AIR CONDITIONING APPARATUS

BACKGROUNG OF THE INVENTION

This application is a continuation-in-part of my copending application Ser. No. 284,909 filed Aug. 30, 1972.

The present invention relates to room air conditioning apparatus and in particular to air conditioning apparatus operative to automatically render and maintain room air temperature at preselected temperature and humidity levels.

The equilibrium vapor pressure of any substance increases more and more rapidly as the temperature thereof is increased. The equilibrium vapor pressure of water ranges from 0.1 mm of mercury at −40°C (i.e. over ice) to about 55 mm of mercury at 40°C. The pressure of water vapor in the air, however, is usually less than the equilibrium value, the existing vapor pressure usually being described by the relative humidity, i.e. the fraction it forms with the equilibrium value at the existing temperature. Thus, in a cold climate, air that is saturated or less than saturated at, for example, 15°F is brought indoors and heated to 75°F, whereupon without change in its actual moisture content, its relative humidity becomes extremely low. Such low humidity is hard on the respiratory passages of the human body, particularly when they double as speech organs, so that it is important to add moisture to heated room air in the wintertime.

It is therefore an object of the present invention to provide an air conditioner operative to automatically ventilate, heat and humidify room air with environmental air to maintain the room air at preselected temperature and relative humidity levels.

It is a further object of the present invention to provide an air conditioner of the character just described, which is compact, economical to manufacture and adaptable for easy installation in a double-hung window.

It is another object of the present invention to provide an air conditioning apparatus which is operative to ventilate, at normal air flow rate, with heated filtered, humidified environmental air that is automatically maintained at operator preselected levels of relative humidity and temperature whereby air flow rates are kept at normal levels so that the energy requirements for air heating and humidification can be met using the wattage levels available from a 110V-15 amp electrical service.

It is yet another object of the present invention to provide air conditioning apparatus operative to rapidly raise the room relative humidity level by circulating room air through the unit and return it to the room at preselected high relative humidity and comfortable temperature levels that are automatically maintained.

It is yet a further object of the present invention to provide an air conditioning apparatus operative to ventilate at high air flow rate, with filtered, and heated environmental air that is automatically maintained at operator preselected temperature levels whereby the high air flow rate is made possible by making the energy that is normally used for humidification available for air heating.

It is still a further object of the present invention to provide an air conditioning apparatus of the character described which is portable so that it can be moved, relatively easily, from one window or wall installation to another without allowing large amounts of cold and relatively low humidity environmental air into the room while doing so.

SUMMARY OF THE INVENTION

In accordance with the principles of the present invention there is an air conditioning apparatus assembly comprising a portable air conditioning unit and an air inlet duct housing having an air inlet port at one end thereof for communication with the ambient air and operative to releasably receive said air conditioning unit at the other end thereof in assembly therewith. The portable air conditioning unit comprises an air duct having an air filter mounted transversely therethrough and an electric air heated mounted transversely therethrough downstream from said air filter, a humidifier chamber located downstream from said electric air heater and operative to controllably impart moisture to the air stream flowing therethrough, and air discharge duct and blower means located downstream of said humidifier chamber for drawing air through said air conditioning unit air duct and said humidifier chamber and expelling said air out through said air discharge duct.

The air conditioning unit air duct has an upper rotatable door mounted in the top wall thereof and a bottom rotatable door mounted in the bottom wall thereof and a louvred shutter mounted in the inlet opening thereof to control the flow of air therethrough. Also provided are air temperature sensing means and humidity sensing means located in the air discharge duct, mode selector switch means operative to selectively render the air conditioning unit into the humidifying mode and ventilating mode respectively by selectively actuating said upper and bottom rotatable doors and said louvred shutter and control means operative in response to the air temperature sensing means and said humidity sensing means for selectively actuating and de-actuating the air heater and humidifier chamber to thereby maintain the temperature and humidity of the air stream of the air discharge duct at preselected levels.

Further objects, features and advantages of this invention will become apparent from a consideration of the following description, the appended claims and the accompanying drawings in which:

DETAILED DESCRIPTION OF THE INVENTION

Figure 1:
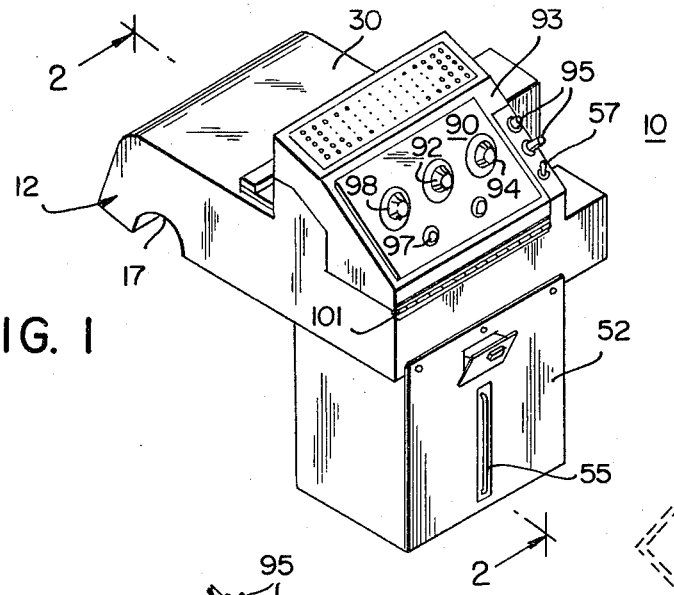
FIG. 1 is a pictorial representation of an air conditioning apparatus constructed in accordance with the principles of the present invention in one embodiment thereof.
Figure 2:
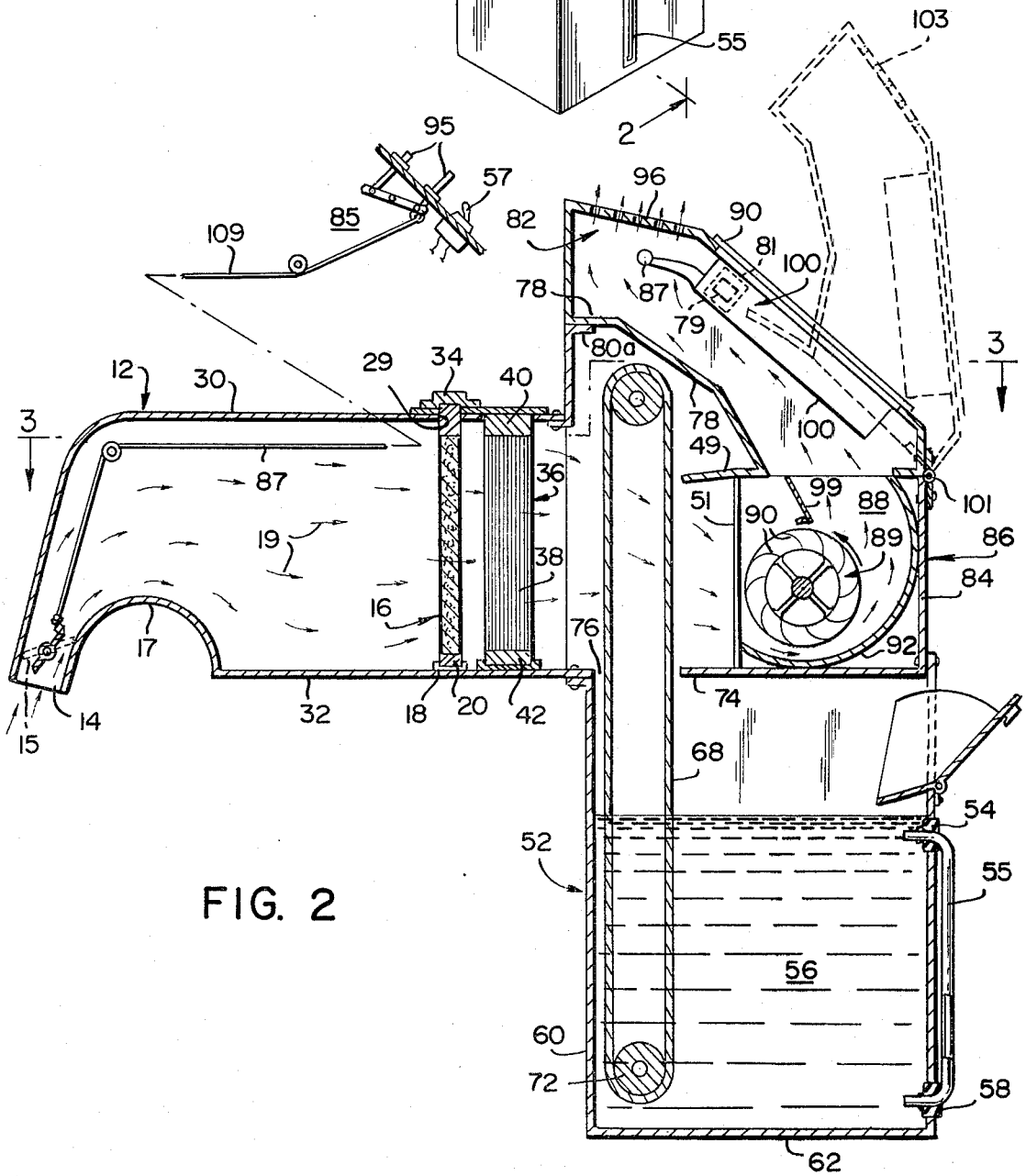
FIG. 2 is a sectional view of the apparatus of FIG. 1 taken along line 2—2.

Referring in detail to the drawings, and in particular to FIG. 1 thereof, an air conditioning apparatus constructed in accordance with the principles of the present invention in one embodiment thereof and for installation in the conventional double-hung window is designated by the numeral 10. Air conditioner 10 comprises an air inlet duct 12 rectangular in cross-section having a downwardly-open throat portion 14 at the forward end thereof for communication with the environmental air outside of the house. An air filter 16 is slidably retained in a pair of vertical slots 18 and 20 fixedly mounted in sidewalls 22 and 24 of duct 12. Air filter 16 comprises a thin rectangular frame 26 enclosing air filter material such as industrial urethane open cell foam 28. A thin rectangular aperture 29 extends transversely across the width of duct top wall 30 to receive air filter 16 and to allow filter 16 to be slidably received downwardly in filter slots 18 and 20 whereupon the bottom edge of filter frame 26 comes to rest upon duct bottom wall 32. A slot cover 34 forms a substantially air-tight seal over aperture 29 once air filter 16 has been inserted into duct 12.

An electric filament heater unit 36 is fixedly mounted between duct top and bottom walls 30 and 32, spaced slightly behind air filter 16. Heater unit 36 comprises a pair of epoxy glass heater frames 33, 35 mounted back-to-back in an aluminum frame 37. Each of epoxy glass frames 33, 35 is divided into three openings to form three sections 33*a*, 33*b*, 33*c*, 35*a*, 35*b*, 35*c*. Approximately 10 feet of 0.010 inches diameter nichrome heater wire 38 having a resistance of about 6.66 ohms/ft is strung across the frame openings on metal standoffs located along the epoxy glass heater frames 33, 35 to form 3 heater screens 38*a*, 38*b*, 38*c* of fairly small mesh interposed across the air flow path, to form a total resistive load of 11 ohms.

Air inlet duct 12 opens into a humdifying chamber 46 bounded by sidewalls 48 and 50 extending from duct sidewalls 22 and 24 respectively. A water tank 52 in the form of a box-like housing 54 extends below humidifying chamber 46 is partially filled with water 56 and is provided with a water level gauge 55. Water tank housing 54 comprises front and rear walls 58, 60, bottom wall 62 and sidewalls 64 and 66. An endless evaporator belt 68 is mounted on top and bottom rollers 70, 72 which are horizontally mounted in a separate frame 21 located in humidifier chamber 46, with top roller 70 mounted across the upper ends of the frame sidewalls 21*a* and 21*b* and bottom roller 72 mounted across the lower ends thereof which is immersed in the water 56. The provision of a separate belt frame 21 permits the removal thereof from humidifier chamber 46 for cleaning or replacement. A suitable material for belt 68 may be that known as industrial urethane open cell foam material similar to air filter material 28 but of larger void area.

Water tank housing 54 is closed at its upper end by means of a top wall 74 which defines a belt opening 76 between the free edge thereof and the rear end of duct bottom wall 32.

An electrical air blower 88 which comprises a centrifugal fan 89 with tangential blades 90 is mounted in blower housing 86 which includes a scroll-shaped duct wall 92 tangentially fixed to tank top wall 74 and blower housing front wall 84. Blower housing 86 at its front end opens into humidifier chamber 46 and into discharge duct 82 at its upper end.

Discharge duct 82 is pivotally mounted to front wall 84 of blower housing 86 by means of hinges 101 whereby discharge duct 82 can be pivoted to the open position depicted by phantom outline 103 to permit access to the interior thereof and blower housing 86. A baffle 99 is provided to direct the air flow produced by blower 88 into discharge duct 82.

Humidifier chamber 46 is bounded at its top end by the underside of discharge duct wall 78 and by front wall 80 which includes a shoulder portion 80*a* for supporting duct wall 78. Duct wall 78 terminates at its lower end in an angle portion 49 which rests on and overhangs the top edge of blower housing wall 51.

An air temperature sensor 87 in the form of a thermistor is located in discharge duct 82 just below grilled air discharge outlet 96. A control panel 90 provided with control buttons and dials for setting the desired air quality characteristics is secured to front wall 93 of discharge duct 82. Thus, dial 92 sets the humidity level, dial 94 sets the speed of evaporator belt 68, buttons 95 control air inlet shutter assembly 85 which controls the movement of air inlet port shutter 15 via cable linkage 109, dial 98 sets the desired air temperature at discharge outlet 96 and indicator light 97 indicating whether evaporator belt 68 is moving or has stopped. The electronic sensing and control circuitry for accomplishing the functions controlled by dials 92, 94, 98 are located in a rectangular housing 100 which is secured to the inside of duct front wall 93.

In operation, unit 10 is installed in a room window by resting the underside of inlet duct 12, i.e. bottom wall 32, on the window sash (not shown) and allowing water tank housing 54 to overhang the window sill along the wall adjacent to the window. Bottom wall 32 is provided with a shoulder 17 to clear the storm window frame (not shown) which is commonly found in windows. When electrical power is applied to blower 88, a negative air pressure, i.e., suction pressure, is created in inlet duct 12, and humidifying chamber 46, i.e. upstream from blower 88, thereby drawing environmental air into air inlet port 13. Air inlet duct 12 is provided with air inlet port shutter 15 to control the flow of environmental air into inlet duct 12, and which as mentioned above is opened and closed manually by means of a cable linkage 85.

The air flow, whose path is indicated by dashed line 19, continues from the mouth of inlet port 13 through duct 12 and through air filter 16 where the air filtration process takes place, namely the removal of relatively small particles of dirt and dust from the air. The smaller the size of the open cells in the air filter foam material 28, the better the filtration capabilities of filter 16. The smallness of the size of the foam material open cells will be limited by the air moving capabilities of blower 88, i.e. its ability to overcome the air flow impedance path through air filter foam material 28.

The location of air filter 16 upstream from heater unit 36 and humidifier chamber 46 is significant in that air borne dust or dirt particles are thereby removed from the air stream before the air reaches the heating elements of heater unit 36 and evaporator belt 68. Otherwise, air-borne dirt particles in the air stream would tend to foul the heating elements 38 and would also cause the creation of unpleasant odors in addition to increasing the resistance of the heat transfer path from heating elements 38 to the air stream. Because the air filter material 28 comprises open cell foam material it can be easily cleaned by using an ordinary house-hold portable vacuum cleaner after removing filter 16 from air inlet duct 12, without disturbing the installation of unit 10.

After passing through air filter 16, the air flow continues through heater unit 36 which is operative to raise the temperature of the air passing therethrough as measured by air temperature sensor 87 to a temperature corresponding to the setting of air temperature dial 98. The air stream then passes through evaporator belt 68 which is saturated with water that has been picked up as belt 68 passes through the water 56 in water tank 52.

The elements of air conditioner 10 which accomplish the air heating and temperature control of the air stream are respectively heater unit 36 and the proportional controller which includes air temperature sensing thermistor 87. The proportional controller may advantageously constitute a "phase voltage firing" controller 83 which is operative to maintain a relatively fixed discharged air temperature at discharge outlet 82 within the temperature range available at temperature control dial 98, typically 60°F – 75°F, regardless of changes in either the environmental air temperature or the flow rate of the air stream. Thus, by way of example, for a fixed air flow rate of 30 – 40 CFM, the proportional controller can maintain a discharge air temperature of 70°F for environmental air temperatures ranging from 70°F –—20°F. It is appreciated that instead of the "phase voltage firing" controller just described, a "zero voltage firing" proportional controller may be utilized, which although not capable of maintaining the discharge air temperature as precisely as the "phase voltage firing" controller, may nevertheless be desirable where radio frequency interference may be a serious problem.

Continuous air humidification sensing and control for the air flow in humidifier chamber 46 is accomplished in the following manner. Humidification sensing of the air stream in discharge duct 82 may be accomplished by using materials which exhibit a change in some parameter thereof which has a known relationship with the relative humidity level of the air stream. Such materials are of two kinds, firstly the dimensional type which are particularly suitable for on-off control of the parameter which governs the evaporation rate, and secondly, material which when coupled with a displacement transducer which produces a continuous electrical output for the continuous control of the evaporation rate parameter, i.e. the relative humidity level. The latter electrical parameter change type materials are best suited for the continuous or proportional type control of the relative humidity control parameter, in which case, signal converters are ordinarily required to convert the output of the humidification sensor to an electrical signal suitable for control purposes.

The nylon tape in humidistat 81 expands and contracts in response to an increase and decrease respectively in the humidity of the air passing therethrough. The expansion and contraction of the nylon tape is operative in response to a particular humidity setting of humidistat control dial 92, to actuate the on-off switch (not shown) which supplies electrical power to evaporator belt drive motor 69.

Figure 4:
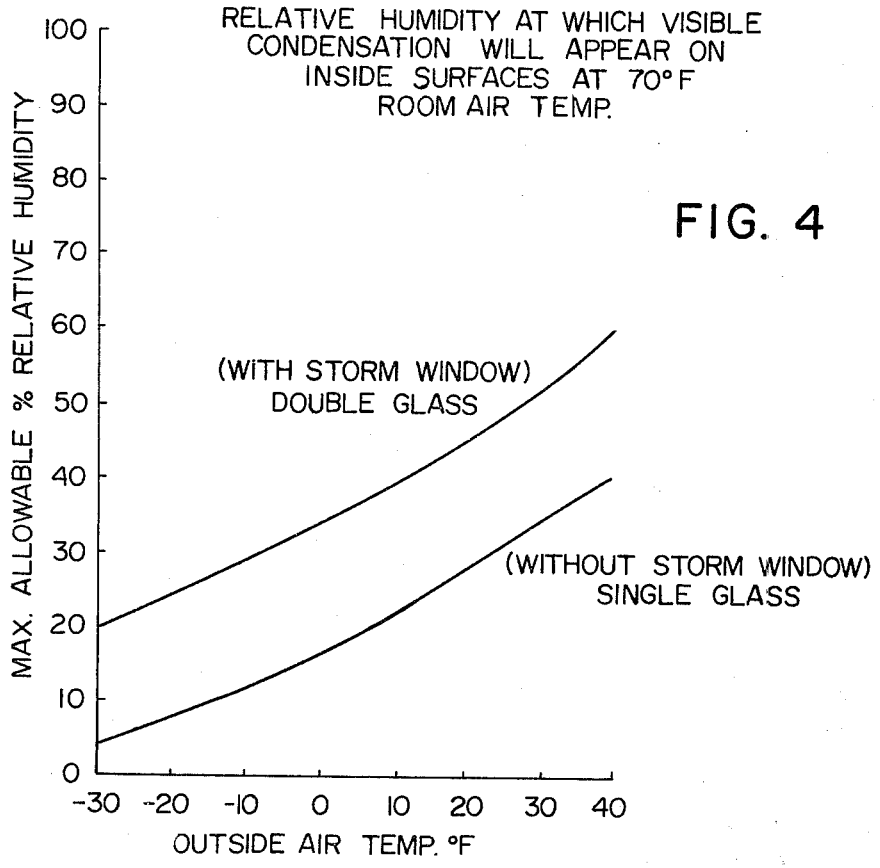
FIG. 4 is a graph of relative humidity at which visible condensation will appear on the inside surface of a window pane at 70°F room air temperature for various environmental air temperature.

The principles of the present invention described herein are based upon the use of an on-off humidity sensing and control system. Thus, an on-off type of humidistat 81 which comprises a humidity sensor 79 of nylon tape may be employed to control the amount of moisture to be imparted to the air stream in humidifier chamber 46 in conjunction with a graph showing maximum allowable relative humidity vs. environmental air temperature such as the graph shown in FIG. 4 to determine the maximum allowable relative humidity for the air discharged from discharge outlet 96. A suitable humidistat 81 for such purpose is the Humidity Controller Type 46B1192-2 sold by Honeywell, Inc.

The operating procedure of unit 10 will now be described for the case of overnight use. The user, having determined the approximate overnight low of the environmental air temperature, examines the maximum allowable relative humidity reading from the above-mentioned graph of maximum allowable relative humdity vs. environmental temperature curve. He then sets humidistat control dial 92 to the relative humidity level corresponding to the environmental air temperature and sets belt speed control dial 94 to its maximum setting. Power to unit 10 is them provided by actuating unit on-off switch 57 and belt drive on-off indicator light 97 is observed. If indicator light 97 remains continuously on, this would be an indication that the humidification process is operating at its maximum capacity and that the relative humidity of the discharge air is not greater than that set by humidistat control dial 92. If, however, indicator light 97 lights up intermittently, this would indicate that the relative humidity of the discharge air is greater than the relative humidity setting of humidistat control dial 92, calling for manual correction by reducing the speed of evaporation belt 68 by adjusting dial 94 in successive small steps until belt drive indicator light 97 remains continuously on, indicating that the discharge air relative humidity has not exceeded the setting of humidistat control dial 92.

Figure 5:
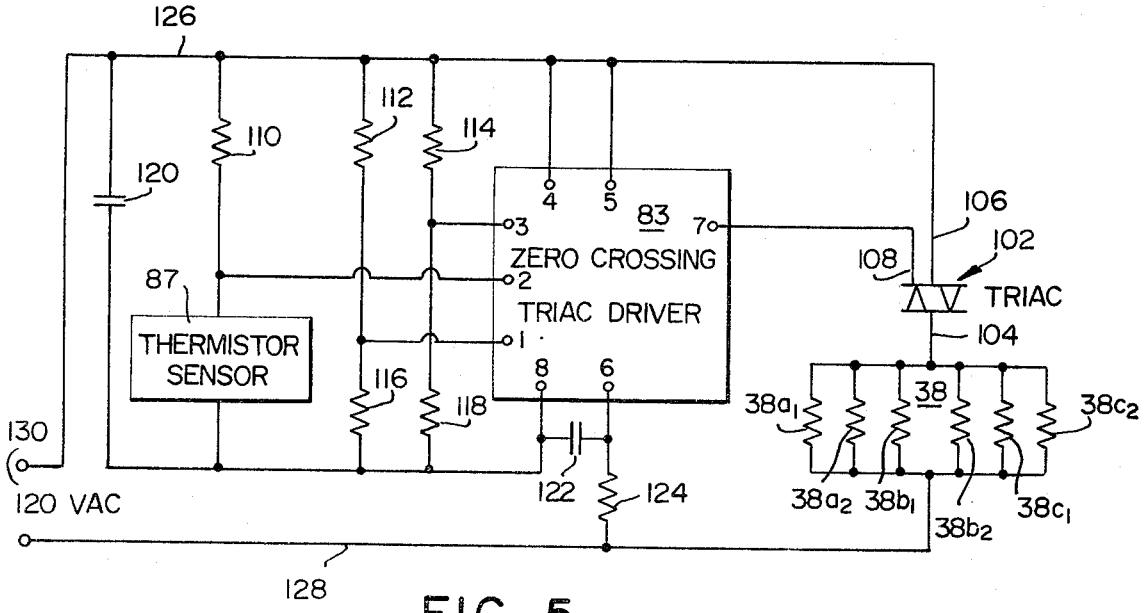
FIG. 5 is an electrical schematic diagram of the air temperature controller circuit of the present invention.

Referring to FIG. 5 the air temperature controller circuit for controlling the temperature of air flow in discharge duct 82 is shown in schematic form. The 3 heater screens 38*a*, 38*b* and 38*c* appear as six resistive elements $38a_1$, $38a_2$, $38b_1$, $38b_2$, $38c_1$ and $38c_3$ connected in parallel with a total resistive load of 11 ohms. This resistive circuit 38 is connected at one end to one electrode 104 a Triac 102 which has another electrode 106 thereof jointly connected to zero-crossing Triac drive circuit terminals 4 and 5 and a gate electrode 108 connected to terminal 7 of Triac driver circuit 83. Thermistor 87 comprises one leg of a bridge circuit including resistors, 110, 112, 114, 116 and 118 whereby the junction of thermistor 87 and resistor 110 is connected to terminal 2 of Triac driver circuit 83, the junction of resistors 112 and 116 is connected to terminal 1, and the junction of resistors 114 and 118 is connected to terminal 3 of Triac driver circuit 83. Additionally a capacitor 120 is connected across resistor 110 and thermistor 87, a capacitor 122 is connected across terminals 6 and 8 of Triac driver circuit 83 and resistor 124 is connected between terminal 6 of Triac driver circuit 83 and the other end of resistive heater circuit 38. The air temperature controller circuit of FIG. 5 is connected to a standard 120 volts A.C. power source 130 by leads 126 and 128 which are respectively connected to terminals 4 and 5 of Triac driver circuit 83 and the other end of heater circuit 38.

In operation, Triac driver circuit 83 is operative to compare the voltage produced across thermistor 87 corresponding to the measured air temperature with a preselected voltage corresponding to the desired air temperature as determined by air temperature control dial 98. If the thermistor voltage is less than the reference voltage, a control voltage signal is produced at Triac driver circuit terminal 7 which is applied to gating electrode 108 of Triac 102 causing Triac 102 to fire and thereby connect heater circuit 38 to power source 130 to cause heater 38 to heat the air stream in discharge duct 82. The resultant increase in the temperature of the air flow is discharge duct 82 is reflected in a corresponding increase in the voltage across thermistor 83 and when the air temperature increases to above the preselected level the voltge signal terminal 7 of Triac driver circuit 83 ceases and Triac 102 presents an open circuit across its electrodes 104 and 106 thereby deenergizing heater circuit 38.

In addition to using unit 10 on a continuous basis as just described, unit 10 may be employed for short periods of time in a conventional humidifier mode for the purpose of raising the relative humidity level of the room air just prior to ventilating, by making slight modifications (not shown) in the design of unit 10. For such opertion, a second inlet port would be provided just upstream of air filter 16 as well as a two-speed motor (not shown) for driving blower 88. In this mode of operation, humidistat dial 92 and evaporator belt dial 94 are set to their maximum settings respectively. Air inlet port 14 is closed while the above-mentioned second inlet port (not shown) is opened and blower 88 is turned on to its high speed operation.

Second Embodiment - FIGS. 6–11

In a second embodiment of the present invention, there is provided a two-part air conditioning apparatus comprising a roomside portable air conditioning unit and an air inlet duct housing for installation in a conventional double hung window. This embodiment, as hereinafter described in detail, is provided with mode selector switch means operative to selectively render the air conditioning apparatus into the humidifying and ventilating modes respectively and is further characterized by the fact that insertion and withdrawal of the portable roomside unit automatically opens and closes the air inlet duct door respectively.

Figure 6A:
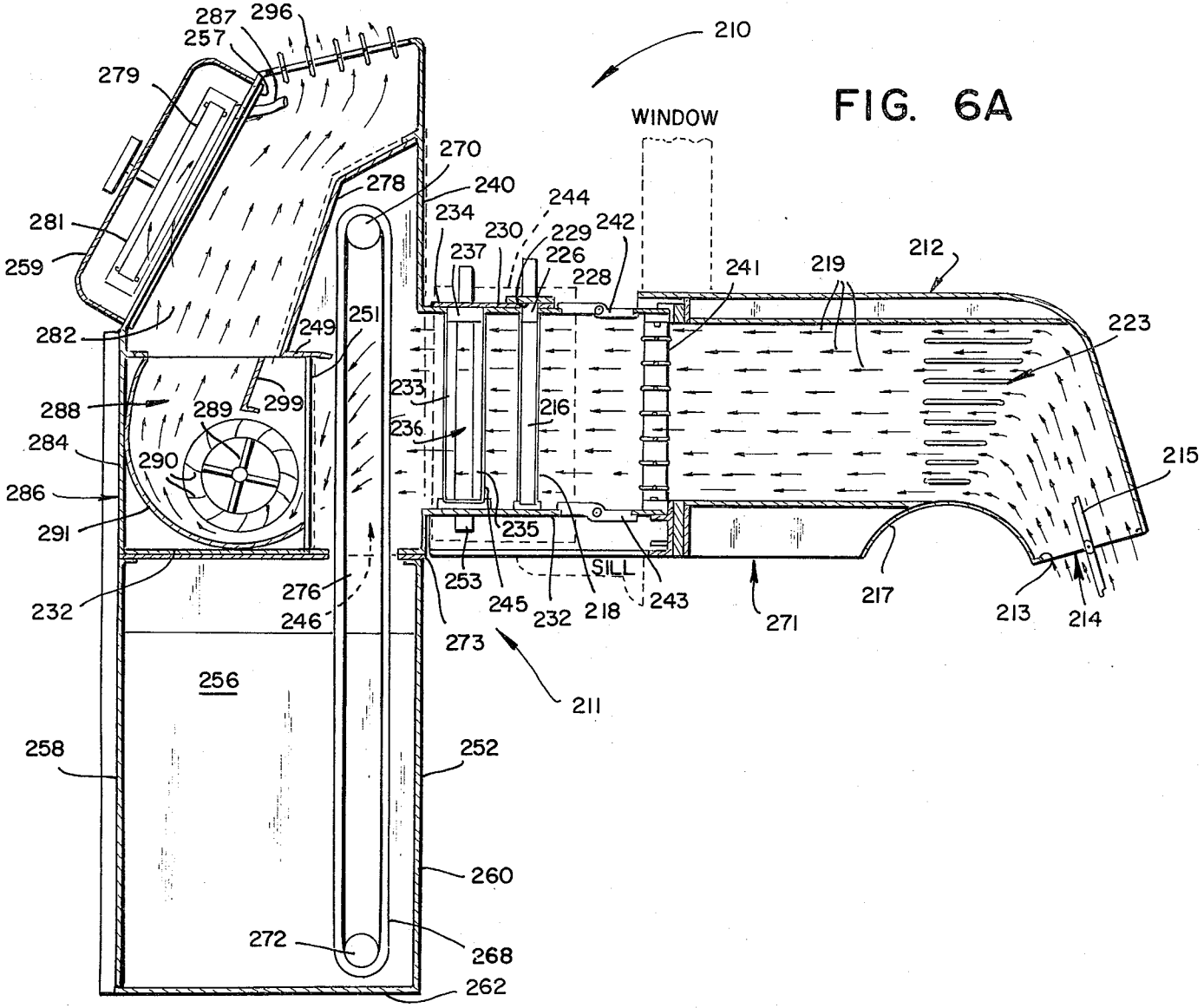
FIG. 6A is a sectional view taken along the line 6—6 of FIG. 7 of a portable air conditioning apparatus constructed in accordance with the principles of the present invention in a second embodiment thereof, when said unit is in the ventilating mode.
Figure 6B:
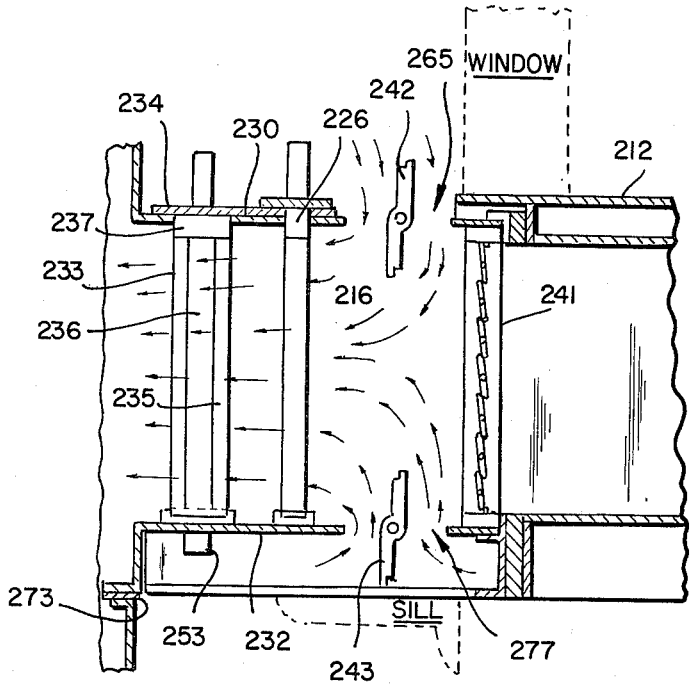
FIG. 6B is fragmented sectional view of the apparatus of FIG. 6A when the latter is in the humidifying mode.
Figure 9:
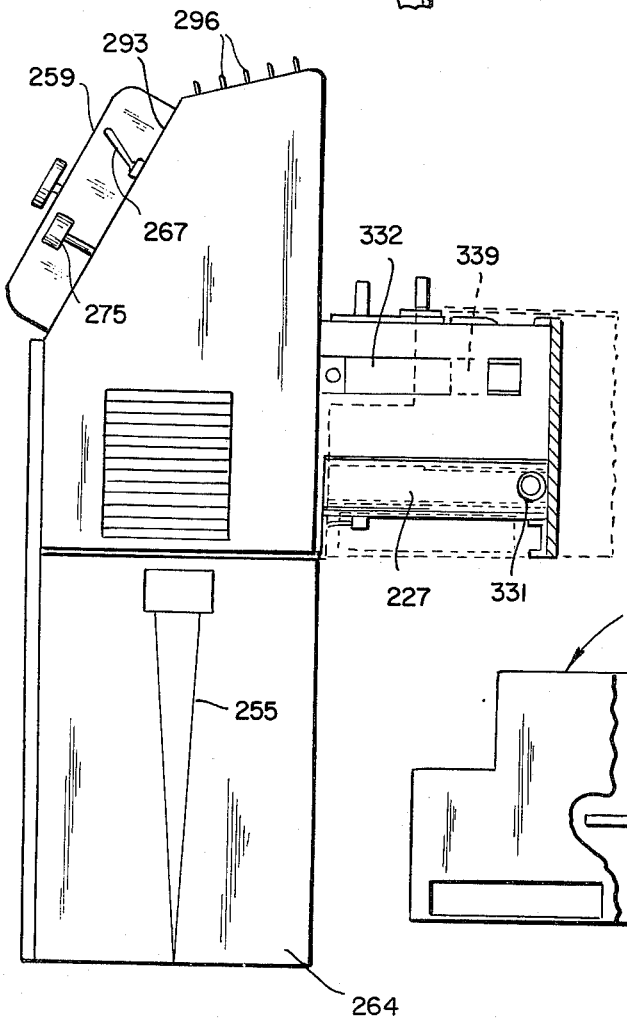
FIG. 9 is an end elevation view of the portable portion, i.e. roomside portion, of the air conditioning apparatus of FIG. 6A.

Referring in detail to the drawings, and in particular to FIGS. 6*a* and 6*b* thereof, an air conditioning apparatus constructed in accordance with the principles of the present invention for installation in a conventional double hung window is designated by the numeral 210. Air conditioner apparatus 210 comprises an air inlet duct 212 and portable air conditioner unit 211. Air inlet duct 212 is rectangular in cross-section having a downwardly-open throat portion 214 at the forward end thereof for communication with the environmental air outside of the house. Air straightener 223, located down stream from throat 214 gives better vertical distribution of air across rectangular duct and therefore through the heaters further downstream. Rotatable air inlet door 215 located at mouth of the throat 214 is attached to actuating door mechanism 225 (see FIG. 8) and is operated by insertion and removal of portable air conditioning unit 211. Slides 227, rollers 231 and catch blocks 239 are provided in air outlet opening of air duct 212 for attachment and support of portable air conditioner unit 211.

Portable air conditioning unit 211 consists of a housing 240 in which is contained a shutter door 241 comprising rotatable louvres that control environmental air entering the unit. Two rotatable doors, the upper door 242 located in the filtering and heating section top wall and the lower door 243 in its bottom wall, control room air entering the unit.

An air filter 216 is slidably retained in a pair of vertical slots 218 fixedly mounted in side walls 222 and 224 of filtering and heating section 244. Air filter 216 comprises a thin rectangular frame 226 enclosing air filter material such as industrial urethane open cell foam. A thin rectangular aperture 229 extends transversely across the width of section 244 to receive air filter 216 and to allow filter 216 to be slidably received downwardly in filter slots 218 whereupon the bottom edge of filter frame 226 comes to rest upon section bottom wall 232. A slot cover 234 forms a substantially air tight seal over aperture 229 once air filter 216 has been inserted into section 244.

An electric open wire heater unit 236 is slidably retained in a pair of vertical slots 245 fixedly mounted in side walls 222 and 224 of filtering and heating section 244 and located slightly down stream from air filter 216. Heater unit 236 comprises a pair of ceramic heater frames 233 and 235 mounted back-to-back in an aluminum frame 237. The frames are wound with an appropriate valued (ohms/ft.) nichrome heater wire to produce a small mesh interposed across the air flow path capable of dissipating a maximum power of 1200 watts. The heater unit 236 is electrically connected or disconnected from electrical connector 253 in the process of inserting it into, or removing it from section 244.

Figure 3:
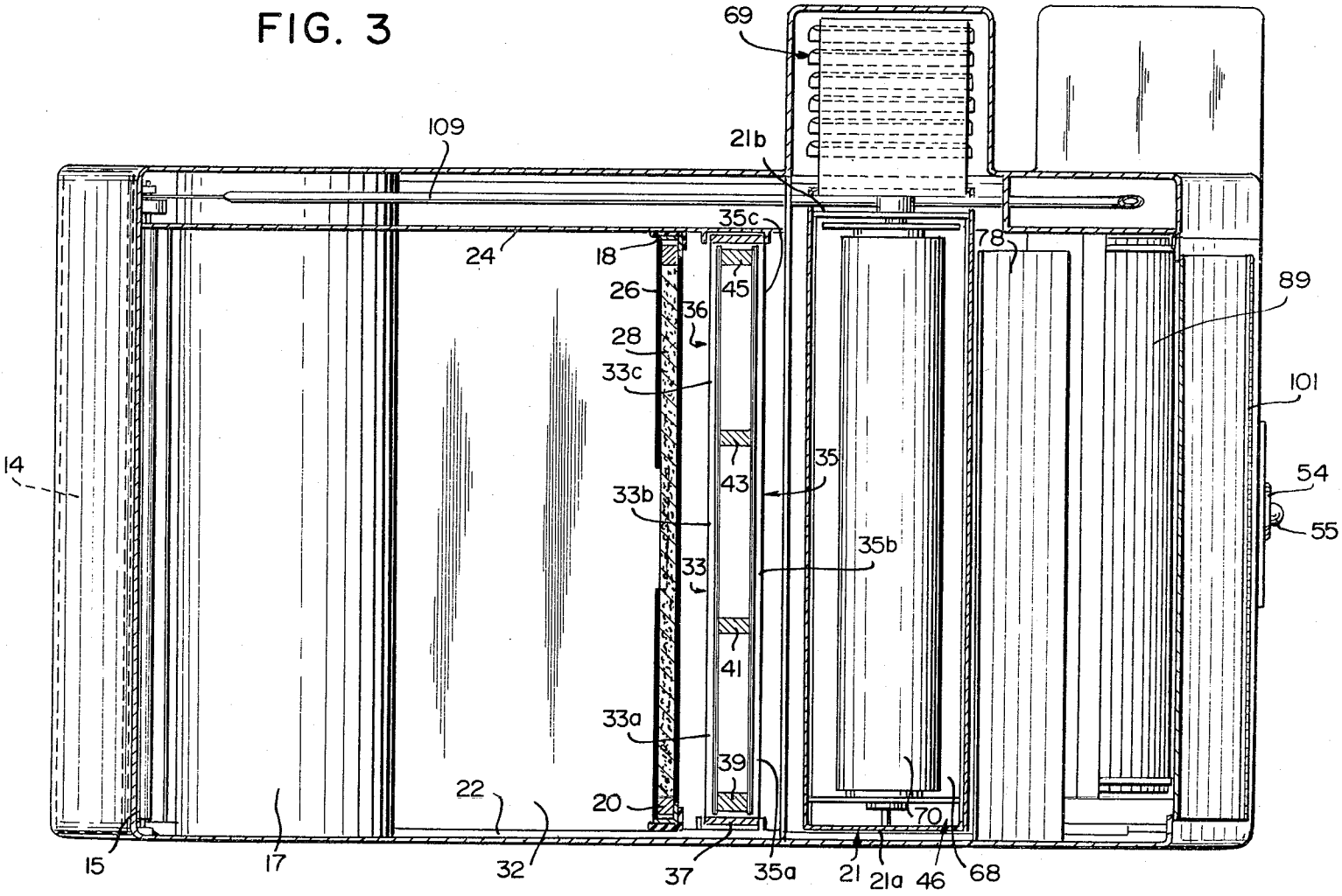
FIG. 3 is a sectional view taken along the line 3—3.

Filtering and heating section 244 opens into humidifying chamber. A water tank 252 in the form of a box like housing 254 extends below humidifying chamber 246 is partially filled with water 256 and is provided with a water level indicator 255. Water tank housing 254 comprises front and rear walls 258 and 260, bottom wall 262 and side walls 264. An endless evaporator belt 268 is mounted on top and bottom rollers 270 and 272 which are horizontally mounted in a separate frame (not shown, but similar to frame 21 of FIG. 3) located in humidifier chamber 246, with top roller 270 mounted across the upper ends of the frame side walls and bottom roller 272 mounted across the lower ends thereof which is immersed in the water 256. A suitable material for belt 268 may be that known as industrial urethane open cell foam material similar to air filter material 228 but of larger void area. The water tank 252, the evaporator belt frame, with rollers 270 and 272, evaporator belt 268 and splash cover 273 constitute a separately detachable sub-assembly 221. The upper end of the evaporator belt frame is inserted upwardly into the humidifier chamber 246 through slot 276 in bottom plate 232 when the tank 252 is attached.

An electrical air blower 288 which comprises a centrifugal fan 289 with tangential blades 290 is mounted in blower housing 286 which includes a scroll-shaped duct wall 291 tangentially fixed to bottom plate 232 and blower housing front wall 284. Blower housing 286, at its front end opens into humidifier chamber 246 and into discharge duct 282 at its upper end. A baffle 299 is provided to direct the air flow produced by blower 288 into discharge duct 282.

Discharge duct 282 is bounded on its upper side by perforated plate 257 and on its lower side by duct wall 278. Duct wall 278 forms the upper bounding wall of humidifier chamber 246 and is supported on its end by shoulder portion 280*a* and is terminated at its lower end by angled portion 249 which rests on and overhangs the top edge of blower housing wall 251. Perforated plate 257 allows a portion of the discharge duct air to reach the humidity sensitive tape 279 in humidistat 281 and to cool the proportional controller components while the remainder is deflected back into and/or through the discharge duct 282.

An air temp sensor 287 in the form of a thermistor is located in discharge duct 282 just below adjustable louvred air discharge outlet 296. Control panel 259 provided with dials for setting the desired air quality characteristics is secured to the front wall 293 of the discharge duct 282 over the perforated plate area Dial 292 (FIG. 7) sets the humidity level, while dial 298 sets the temperature level of the discharge air. Indicator light 297 indicates whether evaporator belt 268 is moving or stationary. Indicator lights 261 and 263 indicate the ventilating and humidifying modes of operation respectively. The electronic sensing and control circuitry for accomplishing the functions controlled by dials 292 and 298 are attached to the inside surface of the control panel 259. The mode selector switch 275 and the on-off power switch 267 are located to the right of the control panel.

In operation, the unit 211 is inserted into air inlet duct 212 that has previously been installed in a room window by resting the under side of duct 212 on the window sash or sill. Duct 212 must be securely fastened to the window sill and/or window frame with all voids not blocked by the duct, weather sealed with an appropriate material (closed cell rubber foam, or polystyrene foam, etc.). Bottom wall 271 is provided with a shoulder 217 to clear the storm window frame (not shown) which is commonly used in windows. When electrical power is applied to blower 288, a negative air pressure i.e. suction pressure, is created in humidifying chamber 246 and filtering and heating section 244. Air will enter the unit either through shutter door 241 or rotatable doors 242 and 243 depending on whether the unit is operating in the ventilating or humidifying mode respectively.

Figure 8:
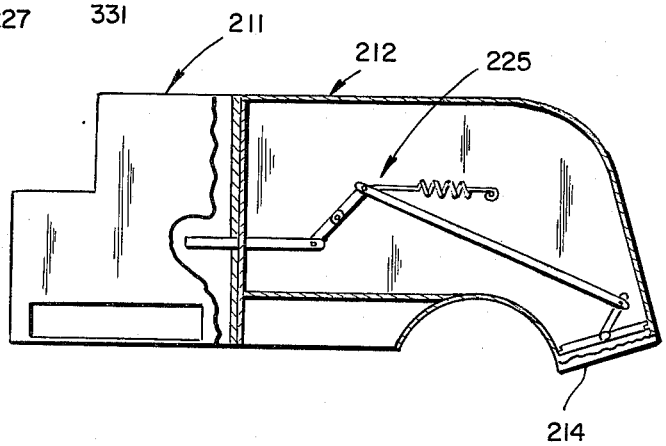
FIG. 8 is a side view of the air inlet duct and air inlet door mechanism of the apparatus of FIG. 6A.
Figure 7:
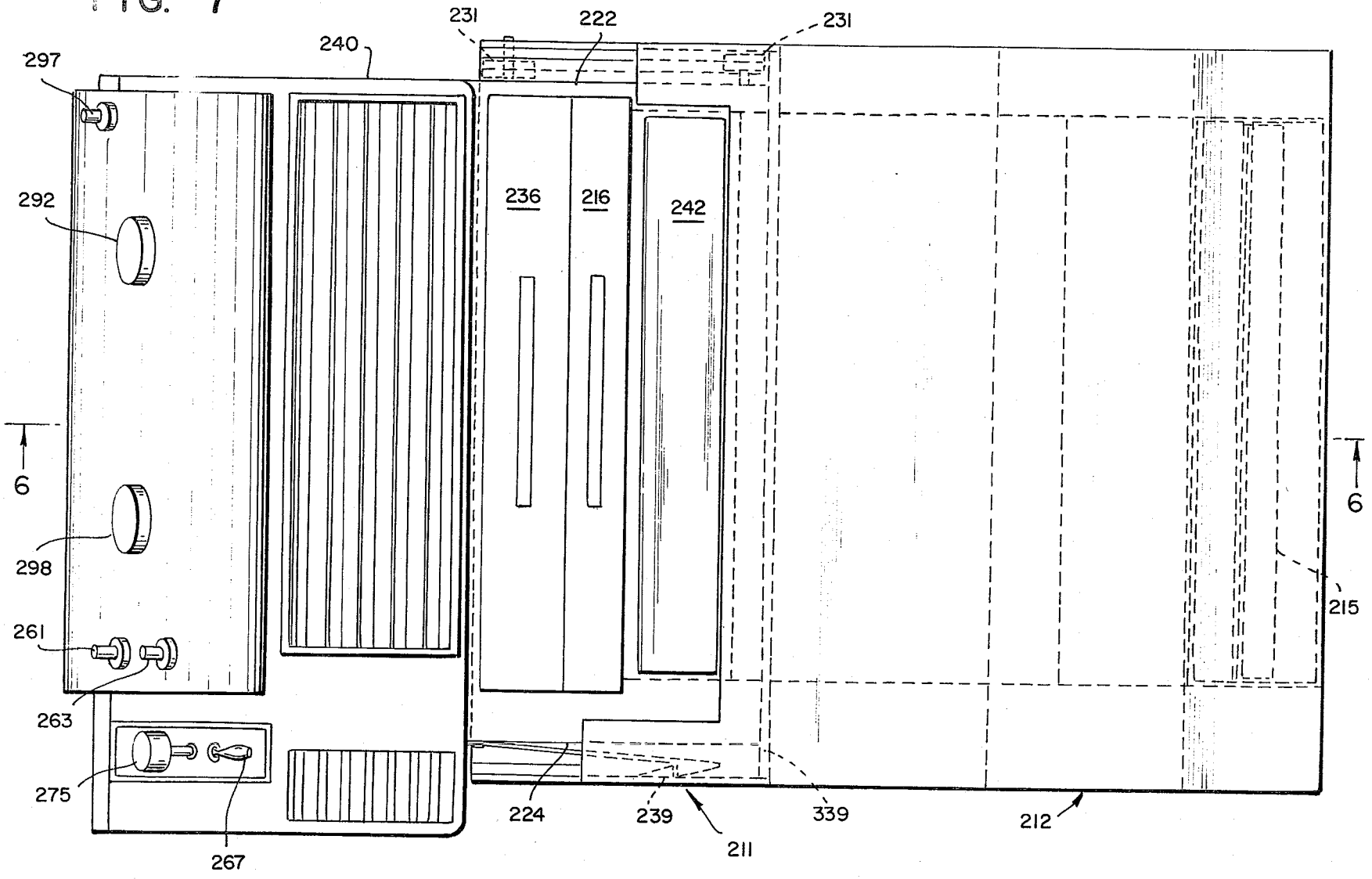
FIG. 7 is a plan view of the portable air conditioning apparatus of FIG. 6A.

The air flow path is indicated by dashed arrows 219 in FIG. 6*a* for the ventilating mode and in FIG. 6*b* for the humidifying mode. In the ventilating mode, the environmental air enters the unit through air inlet port 213 whose inlet port shutter 215 is fixedly open as long as portable air conditioning unit 211 remains installed in air inlet duct 212 (the actuating mechanism that operates inlet port shutter 215 is shown in FIG. 8). After passing through throat 214 the air passes over the air straigheners 223 which vertically redistributes it across the duct. This insures that the air will be uniformly heated by the electric heater further downstream. In the humidifying mode the room air enters the unit through air inlet ports 265 and 277. The upper and lower air inlet port arrangement minimizes the protrusion of the unit beyond the window sill and allows for good air flow distribution through the electric heater. Regardless of which mode the unit is operating in, the air travels the same path from this point on. The air flow passes through air filter 216, where the air filtration process takes place, namely the removal of relatively small particles of dirt and dust from the air. The smaller the size of the open cells in the air filter foam material the better the filtration capabilities of filter 216. The smallness of the size of the foam material open cells will be limited by the air moving capabilities of blower 288, i.e. its ability to overcome the air flow impedance path through the whole unit.

The location of air filter 216 upstream from heater unit 236 and humidifier chamber 246 is significant in that air borne dust or dirt particles are thereby removed from the air stream before the air reaches the heating elements of heater unit 236 and evaporator belt 268. Otherwise, air-borne dirt particles in the air stream would tend to foul the heating elements and would also cause the creation of upleasant odors in addition to increasing the resistance of the heat transfer path from the heating elements 238 to the air stream. Because the air filter material comprises open cell foam material it can be easily cleaned by using an ordinary household portable vacuum cleaner after removing filter 216 from section 244 without disturbing the installation of unit 211.

After passing through air filter 216, the air flow continues through heater unit 236 which is operative to raise the temperature of the air passing therethrough to a sufficiently high level to compensate for the cooling effect on the air due to its later passage through the water saturated evaporator belt 268. This compensation is such that the air temperature, as measured by sensor 287 corresponds to the setting on air temperature dial 298.

The elements of air conditioner 210 which accomplish the air heating and temperature control of the air stream are respectively heater unit 236 and the proportional controller (See FIG. 5) which includes air temperature sensing thermistor 287. The proportional controller may advantageously constitute a "phase voltage firing" controller which is operative to maintain a relatively fixed discharge air temperature at discharge outlet 296 within the temperature range available at temperature control dial 298, typically 60°F – 75°F, regardless of changes in either the environmental air temperature or the flow rate of the air stream or the cooling effect on the discharge air of the evaporation process. Thus, by way of example, for a fixed air flow rate of 25 CFM, the proportional controller can maintain a discharge air temperature of 70°F for environmental air temperatures ranging from 70°F – 0°F. It is appreciated that instead of the "phase voltage firing" controller just described, a "zero voltage firing" proportional controller may be utilized, which although not capable of maintaining the discharge air temperature as precisely as the "phase voltage firing" controller, may nevertheless be desirable where radio frequency interference may be a serious problem.

Continuous air humidification sensing and control for the air flow in humidifier chamber 246 is accomplished in the following manner. Humidification sensing of the air stream in discharge duct 282 may be accomplished by using materials which exhibit a change in some parameter thereof which has a known relationship with the relative humidity level of the air stream. Such materials are of two kinds, firstly the dimensional type which are particularly suitable for on-off control of the parameter which governs the evaporation rate, and secondly, material which when coupled with a displacement transducer produces a continuous electrical output for the continuous control of the evaporation rate parameter, i.e. the relative humidity level. The latter electrical parameter change type materials are best suited for the continuous or proportional type control of the relative humidity control parameter, in which case, signal converters are ordinarily required to convert the output of the humidification sensor to an electrical signal suitable for control purposes.

The nylon tape in humidistat 281 expands and contracts in response to an increase and decrease respectively in the humidity of the air passing therethrough. The expansion and contraction of the nylon tape is operative in response to a particular humidity setting of humidistat control dial 292 to actuate the on-off switch (not shown) which supplies electrical power to evaporator belt drive motor 269.

The principles of the present invention described here in are based upon the use of an on-off humidity sensing and control system. Thus, an on-off type of humidistat 281 which comprises a humidity sensor 279 of nylon tape may be employed to control the amount of moisture to be imparted to the air stream in humidifier chamber 246 in conjunction with a graph showing maximum allowable relative humidity vs. environmental air temperature such as the graph shown in FIG. 4 to determine the maximum allowable relative humidity for the air discharged from discharge outlet 296. A suitable humidistat 281 for such purpose is the Humidity Controller type 46B1192-2 sold by Honeywell, Inc.

The combination and arrangement of heater 236, humidifier belt 268, air temperature sensing means 287 and controller 283, and humidistat 281, maintains the discharge air temperature and percent relative humidity (% R.H.) relatively constant over the full range of operating conditions, minimizes the energy required to do it and give the unit humidification capability, in both modes of operation, that exceed the conventional console floor model humidifiers.

The psychrometric processes to which air flow is subjected. can be explained in the following manner. Whether in the ventilating or purely humidifying mode of operation the air flow receives all the input energy from the heater 236 (needed to raise it to the dial temperature setting and compensate for the cooling effect of the evaporation process) prior to passing through the humidifier belt 268. This means that the air reaching the humidifier belt 268 is at an elevated temperature, compared with the discharge air temperature, and at a very low % R.H. level. Under these conditions the air has a higher potential moisture absorption capability then could be achieved by any other combination or arrangement of the aforementioned parts. In passing through the humidifier belt 268 the air follows a constant wet bulb temperature line to a % R.H. level determined by the dial temperature setting. The moisture imparting capability of the humidifier belt 268 to the air flow is a function of its moisture content. When the humidifier belt 268 is moving, carrying water from tank 252 into the air stream, the maximum moisture is made available to the air and the maximum energy is required to maintain the air at the dial temperature setting. When the humidistat 281 stops the humidifier belt 268, its moisture content begins to fall, reducing the amount of energy required to maintain the dial temperature setting. Thus, a dynamic situation is created in which the humidistat 281 is cycling on and off trying to maintain its % R.H. setting by moving and stopping the humidifier belt 268, while the temperature sensor 287 coupled with the proportional controller has to continuously increase and decrease the energy input to the heater 236 to maintain the dial temperature setting. The % R.H. level of the discharge air cycles around the humidistat setting. The range and frequency of these excursions is dependent on the response time of the humidistat 281. Enhancement of this response time has been obtained by allowing the maximum amount of conditioned air passing through discharge duct 282 to reach the moisture sensitive tape 279 without impeding the air flow through duct 282. This has been accomplished by designing the discharge duct so that the control panel, which contains humidistat 281 is situated just behind the upper wall of discharge duct 282. By making this upper wall 257 a perforated plate with the proper rate of open area to solid area and angle to the discharge air stream from blower 288, satisfactory response times can be obtained from the on-off type humidistat 281.

The operating procedures for apparatus 210 will now be described for:

a. Removal and reinstallation of unit 211 into air inlet duct 212.

b. Use of the unit 211 as a humidifier using temperature controlled room air.

c. Use of the unit 211 as a room ventilator using normal flow rate, environmental air which is temperature and humidity controlled.

d. Use of the unit 211 as a room ventilator using high flow rate, environmental air that is temperature controlled.

Removal of the unit 211 from air inlet duct 212 by the user starts with the removal of the water tank 252, evaporator belt frame 221, and splash cover 273 as a separate subassembly. It is placed on the floor directly under the unit. Next, the actual removal of the unit 211 is initiated by placing a hand on each side of the unit 211 so that index fingers are resting on flat springs 332. A firm pressure on these springs releases them from catch blocks 239 and the unit can be rolled back on rollers 331 to a point where disengagement of rollers from slides can be accomplished by lifting up the unit. The light weight unit 211 (approximately 5 lbs.) can then be easily carried to, and installed in, the desired air inlet duct 212.

Installation is accomplished by raising the unit 211 slightly above, but in line with the air inlet duct 212 so that the rollers on the unit 211 are directly over the cut away portions in the slides and behind the rollers on the air inlet duct 212. The unit is lowered until rollers and slides make contact, then slid forward like a draw until foam thermal strip 339 (FIG. 7) is compressed and both flat spring catches 332 engage their respective catch blocks 239.

Foam thermal strip 339 has two functions, one is to minimize the heat loss by conduction from the room through the unit to the out-of-doors and the second is to act as a shock absorber when assembling unit 211 with air inlet duct 212.

When this has been accomplished, the air inlet port shutter 215 has been fixedly opened by actuating door mechanism 255. until such time as the unit 211 is removed from the air inlet duct 212. The water tank 254, evaporator belt frame 221 and splash cover subassembly 273 is then reinserted and attached to unit 211 and unit 211 is then ready to operate.

To use the unit 211 in the purely humidifying mode of operation, the mode selector switch button 275 must be in the depressed position. The unit is always left in this mode position when not in use because the shutter door 241 is closed thus preventing untreated, environmental air from entering the room. Also, in this position the mode selector switch mechanism (see FIG. 11) has the blower 288 switched to operate at a high air flow rate, the humidifier indicator light 263 is on and the upper and lower rotatable doors 242 and 243 are open. Before starting up unit 211, both the humidity control dial 292 and the temperature control dial 298 should be set to appropriate values. The humidity control dial 292 setting is determined from the curve in FIG. 4 which is a function of the outside air temperature. The temperature control dial 298 setting should be the same as the room air temperature. Power to the unit 211 is provided by actuating on-off switch 267. If the evaporator belt indicator light 297 comes on when the unit 211 is turned on this would indicate that the evaporator belt 268 is moving, carrying water from the tank 252 into the air stream. If it does not come on, the reverse is true. Regardless of which condition exists, after a short period of operation, the indicator light 297 will begin cycling on and off in the manner previously described.

To use the unit 211 in the ventilating mode, the mode selector switch button 275 must be in the undepressed position. This is accomplished by pressing down on the mode selector switch button 275 until it stops moving and then releasing it. This action causes the blower 288 to be switched to operate at a low air flow rate, the ventilator indicator light 261 becomes operable while the humidifier indicator light 263 is made inoperable, the upper and lower rotatable doors 242 and 243 are closed while shutter door 241 is opened. Both humidity control dial 292 and temperature control dial 298 should be set to appropriate values before turning on the unit 211. Undesirable condensation on cool surfaces or possibly the influx of a large amount of low % R.H. air can be prevented by getting the unit fully functional as quickly as possible. (In this context "fully functional" means humidistat 281 cycling evaporator belt 26 on and off.) This can be accomplished in either of two ways. If the evaporator belt 268 commences moving when the unit is turned on (indicated by indicator light 297 being on) the moisture content of the nylon tape 279 in the humidistat 281 is lower then the setting on the humidistat 281. By letting the unit 211 operate in the humidifying mode, the nylon tape 279 will be rapidly brought up to a moisture level at which it will commence controlling the evaporator belt 268 (indicated by the indicator light 297 going off.) Then the unit 211 can be switched to operate in the ventilating mode. If the evaporator belt 268 does not commence moving (indicated by the indicator light 297 being off) when the unit 211 is turned on, then the moisture content of the nylon tape 279 in the humidistat 281 is higher then the setting on the humidistat 281. By following the procedure described in the next paragraph, the nylon tape 279 can be rapidly brought down to a moisture level at which it will commence controlling the evaporator belt 268 (indicated by the indicator light 297 going on when the humidity control dial 292 is reset to the desired % R.H. level).

Figure 10:
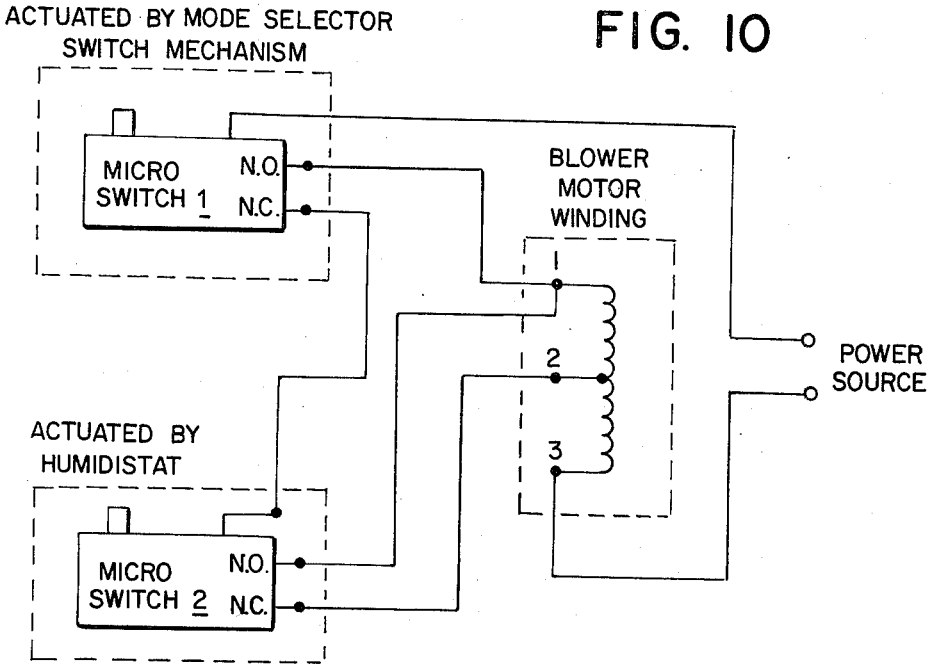
FIG. 10 is an electrical schematic diagram of the switching circuit of the apparatus of FIG. 6A.

When room ventilation with high flow rate, temperature controlled, environmental air is desirable it can be obtained in the following manner. The humidity control dial 292 is turned to the fully off position (indicated by an audible click) while the unit is operating in the ventilating mode. This will cause the evaporator belt 268 to be manually switched off while the blower 288 is switched to operate the humidifier mode high air flow rate. FIG. 10 shows schematically how this is accomplished.

Figure 11:
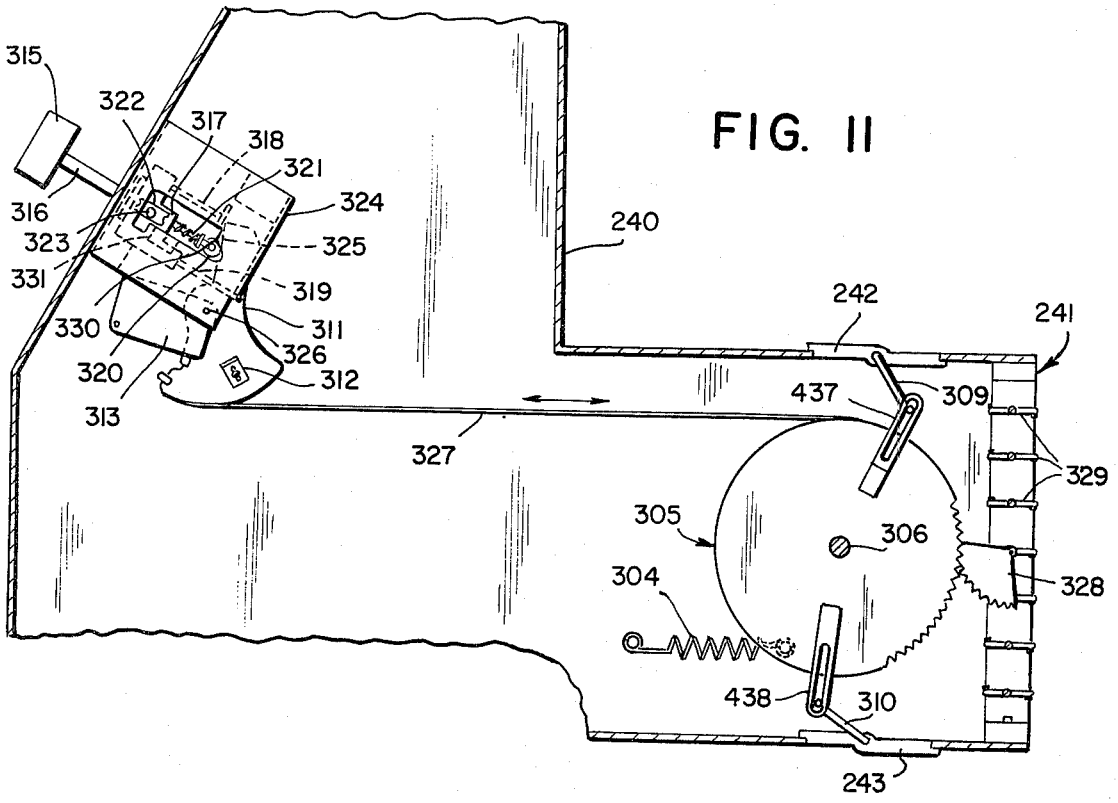
FIG. 11 is a sectional view, partially schematic, of the mode control switch mechanism of the apparatus of FIG. 6A.

Operation of Mode Control Switch Mechanism (FIG. 11)

The mechanism as shown in the FIG. 11 is in the ventilation mode. The shutter door 241, that admits outside air, is open while the upper and lower rotatable doors 242 and 243 that admit room air are held closed by the force exerted by spring 304 on geared wheel 305. (Geared wheel 305 is fixed to rotate about pivot shaft 306.) The spring force is transferred from geared wheel 305 to rotatable doors 242 and 243. In this mode, angle 312 fixedly attached to cam 311, is not in contact with the switch buttons on micro-switches 313. (The micro-switches are stacked on top of each other and only the top one can be seen in this view.) Two results are caused by this condition. Firstly, the blower motor is caused to operate at a reduced speed and secondly, the indicator light on the control panel that indicates the ventilating mode of operation is on.

To switch the unit from the ventilation mode of operation to the humidification mode of operation push-button 315 is depressed until it has moved the full extent of its travel. (Length of total travel is ⅝ inches). Push-button 315 is attached to shaft 316 that is part of sliding mechanism 317. Sliding mechanism 317 contains two guide rods 318 and 319, a rotatable contact roller 320 that is attached to the end of spring loaded slideable shaft 321, and a rotatable cam 322 that is V-notched on both ends and fixed to rotate about pin 323. Sliding mechanism 317 is held and guided in its travel by bracket 324. Contact roller 320 rests against flat surface 325 on cam 311. The force exerted on push-button 315 causes the shaft 316 to move the sliding mechanism 317 that linearly moves the contact roller 320 that is attached to the end of the spring loaded slideable shaft 321, causing the cam 311 to rotate about pivot shaft 326. When the contact roller 320 has traveled linearly 178 inches, the cam 311 has rotated clockwise through 46°. Attached to the circularly curved side of cam 311 is a cable 327 whose other end is attached to the circumference geared wheel 305. The 46° rotation of cam 311 causes a counter clockwise rotation of 34° of geared wheel 305. Geared wheel 305 meshes with gear 328 that controls the opening and closing of shutters 329 on shutter door 241 and rotates it through 90° closing shutter door 241. Geared wheel 305 with attached slotted crank links 437 and 438 rotates the fixedly attached links 309 and 310 to rotatable doors 242 and 243 through 90°, thus opening both rotatable doors fully. Also, angle 312, fixedly attached to cam 311, makes contact with the switch buttons on micro-switches 313. Two results are caused by this action. Firstly, the blower motor is caused to operate at full speed and secondly, the indicator light on the control panel that indicates humidifying mode of operation is switched on while simultaneously the ventilating mode indicator light is switched off.

The last ½ inches of travel of the sliding mechanism 317 is required to lock the cam 311, the geared wheel 305 and thus rotatable doors 242 and 243 open and the shutter door 301 closed. The spring on the spring loaded slideable shaft 321 compresses allowing the sliding mechanism 317 with attached V-notched cam 322 to move ⅛ inch forward, thus allowing the V-notch in V-notched cam 322 to make contact with protrusion 330 on bracket 324. The V-notched cam 322 in making contact with protrusion 330 causes the V-notched cam 322 to rotate counter clockwise slightly. This slight rotation positions it precisely so that when the pressure on push button 315 is released the V-notch on the opposite end of V-notched cam 322 is caught on block 331 which is fixedly attached to bracket 324.

To switch the unit from the humidification mode back to the ventilation mode of operation again, push-button 315 is depressed until the button has moved the full extent of its travel. (Length of travel is ⅛ inch). Slide mechanism 317 with V-notched cam 322 is moved forward ⅛ inch (all other parts of the control switch mechanism except those that are fixedly attached to slide mechanism 317 remain stationary). This movement moves V-notched cam 322 out of contact with block 331 on bracket 324. Again the V-notched cam 322 makes contact with protrusion 330 on bracket 324, but this time, because of its partially rotated position with respect to the line of motion of the slide mechanism 317 (caused by its contact with block 331), the flattened slide of V-notched cam 322 makes contact with the vertical side of protrusion 330 further rotating V-notched cam 322 in a counter clockwise direction. The position that V-notched cam 322 is now in precludes a V-notch from making contact with block 331 in its return travel. When the pressure is removed from push-button 315 the force created by spring 304 on geared wheel 305 pulls cable 327 forward rotating cam 311 counter clockwise, which pushes the slide mechanism 317 back to its initial position. In returning to its initial position the V-notched cam 322 on slide mechanism 317 makes contact with block 331 on bracket 324. This contact is against the side of V-notched cam 322 causing it to rotate about pin 323 and thus preventing obstruction to the slide mechanism 317 returning to its initial position. As a result, the two rotatable doors 242 and 243 and shutter door 241 are returned to their initial positions as well as the switch buttons on micro-switches 313.

Although the invention has been described with reference to particular embodiments thereof, it is to be understood that such embodiments are merely illustrative of the application of the principles of the invention. Numerous modifications may be made therein and other arrangements may be devised without departing from the spirit and scope of the invention.

What is claimed is:

1. Air conditioning apparatus assembly comprising a portable air conditioning unit and an air inlet duct housing having an air inlet port at one end thereof for communication with the ambient air and operative to releasably receive said air conditioning unit at the other end thereof in assembly therewith; said portable air conditioning unit comprising: an air duct having an air filter mounted transversely therethrough and an electric air heater mounted transversely through said air conditioning air duct dowstream from said air filter, a humidifier chamber located downstream from said electric air heater and operative to controllably impart moisture to the air stream flowing therethrough, an air discharge duct, blower means located downstream of said humidifier chamber for drawing air through said air conditioning unit air duct and said humidifier chamber and expelling said air out through said air discharge duct, said air conditioning unit air duct having a top rotatable door mounted in the top wall thereof and a bottom rotatable door mounted in the bottom wall thereof, a louvred shutter being mounted in the inlet opening of said air conditioning unit air duct to control the flow of air therethrough, air temperature sensing means and humidity sensing means located in said air discharge duct, mode selector switch means operative to selectively render said air conditioning unit into the humidifying mode and ventilating mode respectively by selectively actuating said top and bottom rotatable doors and said louvred shutter, and control means operative in response to said air temperature sensing means and said humidity sensing means for selectively actuating and deactuating said air heater and said humidifier chamber to thereby maintain the temperature and humidity of the air stream in said air discharge duct at preselected levels.

2. Apparatus as defined in claim 1 wherein said mode selector switch means is operative to render said air conditioning unit into the ventilating mode by rendering said louvred shutter open and said top and bottom rotatable doors closed.

3. Apparatus as defined in claim 2 wherein said mode selector switch means is operative to render said air conditioning unit into the humidifying mode by rendering said top and bottom rotatable doors open.

4. Apparatus as defined in claim 3 wherein said mode selector switch means comprises a switch assembly and drive means operative in response to the actuation and deactuation of said switch assembly for selectively opening and closing said louvred shutter and said top and bottom rotatable doors respectively.

5. Apparatus as defined in claim 4 wherein said top and bottom rotatable doors respectively include top and bottom crank links fixedly secured thereto and said drive means comprises a drive wheel mounting top and bottom slotted links respectively engaging said top and bottom crank links whereby said top and bottom rotatable doors are respectively opened and closed in response to rotation of said drive wheel in response to the actuation and deactuation of said mode selector switch means.

6. Apparatus as defined in claim 5 wherein said louvred shutter includes a pivotally mounted shutter gear segment for opening and closing said louvred shutter, and said drive wheel includes gear teeth along at least a portion of the periphery thereof for geared engagement with said shutter gear segment, whereby said top and bottom rotatable doors and said louvred shutter are simultaneously opened and closed in response to the rotation of said drive wheel in response to the actuation and deactuation of said mode selector switch means.

7. Apparatus as defined in claim 6 wherein said drive means comprises a pulley cable having one end thereof wrapped around at least a portion of the periphery of said drive wheel and the other end thereof secured to said switch assembly whereby actuation and deactuation of said switch assembly causes said pulley cable to cause said drive wheel to rotate.

* * * * *